United States Patent [19]

Claussen

[11] 4,410,882

[45] Oct. 18, 1983

[54] SYSTEM FOR MONITORING THE IGNITION FUNCTION OF RAPID EXTINGUISHING SYSTEMS

[75] Inventor: Lennart Claussen, Karlskoga, Sweden

[73] Assignee: Aktiebolaget Bofors, Bofors, Sweden

[21] Appl. No.: 357,545

[22] Filed: Mar. 15, 1982

Related U.S. Application Data

[63] Continuation-in-part of Ser. No. 156,232, Jun. 3, 1980, abandoned.

[30] Foreign Application Priority Data

Jun. 13, 1979 [SE] Sweden ..... 7905191

[51] Int. Cl.[3] ..... G08B 21/00

[52] U.S. Cl. ..... 340/510; 169/23; 169/41; 169/61; 340/661

[58] Field of Search ..... 340/506, 507, 510, 511, 340/517, 521, 593, 599, 606, 642, 658, 659, 662, 664, 661; 169/23, 41, 61

[56] References Cited

U.S. PATENT DOCUMENTS

| | | | |
|---|---|---|---|
| 2,871,466 | 1/1959 | Vassil et al. | 340/593 X |
| 3,143,729 | 8/1964 | Power | 340/642 |
| 3,636,540 | 1/1972 | Harris | 340/599 X |
| 3,801,972 | 4/1974 | Ho Kim et al. | 340/510 |
| 3,821,726 | 6/1974 | Chang et al. | 340/606 |
| 4,007,456 | 2/1977 | Paige et al. | 340/507 |
| 4,281,718 | 8/1981 | Claussen et al. | 169/41 |
| 4,359,097 | 11/1982 | Claussen | 169/61 |

OTHER PUBLICATIONS

IBM Technical Disclosure Bulletin; vol. 14, No. 5; Oct. 1971; p. 1368; "Resistance Testor" by A. Yanischeff

*Primary Examiner*—John W. Caldwell, Sr.
*Assistant Examiner*—Daniel Myer
*Attorney, Agent, or Firm*—Pollock, VandeSande & Priddy

[57] ABSTRACT

In a fire sprinkler system a plurality of physically distributed actuators are connected in a normally balanced bridge circuit. The bridge circuit is impressed with a pulsed measuring voltage thereacross to conserve power. LEDs are connected to the bridge for indicating either normal or unbalanced conditions of the bridge as well as indicating which actuator branch of the bridge is causing unbalance.

4 Claims, 2 Drawing Figures

SYSTEM FOR MONITORING THE IGNITION FUNCTION OF RAPID EXTINGUISHING SYSTEMS

Figure 1:
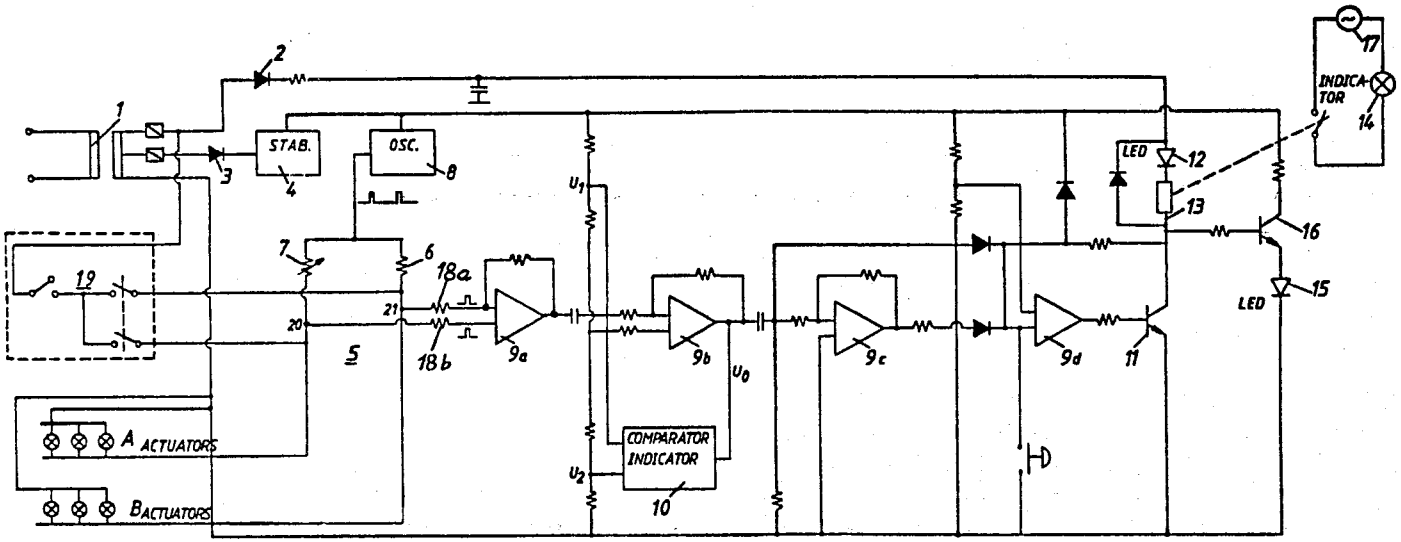

This is a continuation-in-part application of U.S. Ser. No. 156,232, filed June 3, 1980, now abandoned.

The present invention relates to a control system for remote monitoring of the ignition function of rapid extinguishing systems comprising a number of resistively measurable actuators.

In the U.S. Pat. No. 4,281,718 a method and an apparatus for releasing a sprinkler head is described. The function of said apparatus is based upon an electrically-operated actuator comprising a very small pyrotechnical charge which when being ignited electrically, throws a body made of compacted fine particle material towards a hollow glass bulb which normally prevents operation of the sprinkler, thereby shattering the bulb, disintegrating the compacted body and releasing the sprinkler.

If such an actuator is combined with, for example, a bulb and a detector, a very rapid and reliable function will be obtained for releasing an extinguishing fluid, usually water. As a temperature sensitive bulb is comprised in the system, also a temperature dependent releasing is obtained, but then only of the specific sprinkler heads which are subjected to the elevated temperature. Now it can often be desirable, primarily in premises where fires can be expected to develop very rapidly, to have all the sprinkler heads in the fire protection circuit in question released simultaneously at the very first indication of a fire.

In our U.S. Pat. No. 4,359,097 a method and a device for automatically releasing all of the sprinkler heads connected together in a fire protection circuit as soon as one of the sprinkler heads has been released, are described. Such a device comprises a flow indicator connected together with a microswitch, which senses when fluid (fire protection fluid) begins to flow through a riser or the main pipe of a section or sometimes the trunk pipe of the fire protection circuit, which thus commences as soon as one or a plurality of the sprinkler heads have opened, and closes the microswitch, which closes the ignition circuit which in turn via an ignition function activates the actuators at the various sprinkler heads. A releasing of all the sprinkler heads in the circuit as soon as one of these has been released is then obtained.

A fire protection system of the kind described above obviously gives a very rapid and reliable releasing of all the sprinkler heads comprised in the circuit. A condition for this is, of course, that no fault has arisen in the electrical system, i.e. that there is no interruption or short-circuit in the ignition voltage, in the fuses, or in one or a plurality of the actuators. It has previously been necessary to check such a system manually, i.e. personell have had to check the resistance at certain points of the system at regular intervals. However, such a procedure is time-consuming and costly, and does not give the degree of functional reliability that is required for rapid extinguishing systems of the kind mentioned here.

The purpose of the present invention is thus to achieve a control system for monitoring the function ability of the ignition part of an extinguishing system of the above-mentioned kind. The feature that can mainly be considered to characterize the invention is that the actuators are comprised in an electrical bridge circuit which is fed with a pulsed measuring voltage and is adjusted in such a way that an unbalance condition occur in the bridge when a fault in the form of a substantial resistance change of an actuator arises, and that means are arranged for indication of said unbalance signal.

Figure 2:
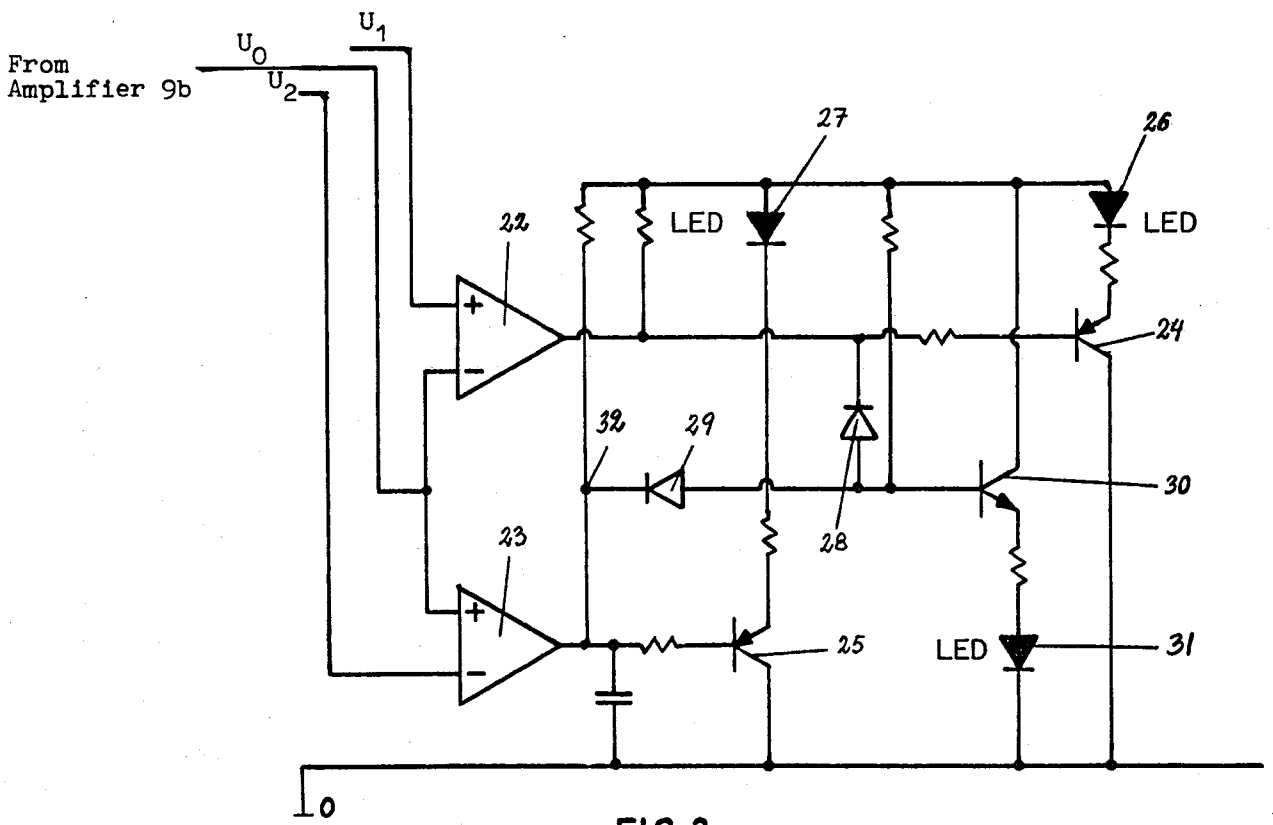

The invention will be described in more detail in the following, with reference to the accompanying drawings, in which FIG. 1 shows the monitoring system and FIG. 2 shows the comparator for indication of the balance position which is comprised in the system.

From FIG. 1 it will be noted that the monitoring system comprises a transformer 1 for conversion of the main supply voltage into an appropriate ignition and DC supply voltage. The main supply voltage is rectified with the aid of two diodes 2 and 3, and is stabilized on a certain level, for instance +15 V, by means of a stabilizing unit 4.

The system also comprises a resistive electrical bridge circuit 5 of the Wheatstone type comprising four branches. In one of the branches a group of actuators, connected in parallel and designated A in the figure, and covering a certain portion of the premises, is included, while another group of actuators, designated B in the figure, covering the remaining part of the premises is included in the adjoining branch. The figure includes three actuators connected in parallel in each bridge branch, but it should be obvious that this is only an example, and that a greater or lesser number of actuators can be included.

As fire protection systems of the kind mentioned in the introductory part of our specification are primarily intended for industrial buildings and other large premises, the branches in which the actuators are comprised can have a length of up to approx. 100 m. Such a length of the connections naturally involves severe requirements for temperature compensations, particulary with regard to the fact that the actuators are usually low-ohmic, and therefore a multi-conductor cable, specifically a five-conductor cable, put into one sheathing is utilized for the connection of the two branches. In this way, temperature variation will be compensated, since the two branches in the bridge circuit are equally affected by changes in temperature.

The two other adjoining branches of the bridge circuit comprise a fixed resistor 6 and a variable resistor 7 for adjusting the balance condition.

For the rest, the bridge circuit is connected in a conventional way with one of its diagonals connected to a voltage source, which in this case consists of an oscillator 8 which feeds a pulsed voltage to the bridge. The reason why a pulsed measuring voltage is utilized for monitoring the actuators is that the power consumption and the heating of the actuators can be kept low. This is important in order to extend the life of the actuators.

The other diagonal of the bridge is connected to a first amplifier stage **9*a* to amplify the output signal from the bridge circuit. The output of this first amplifier stage 9*a* is connected to a second amplifier stage 9*b*, which output is connected to a comparator indicator 10 for optical indication of the balance position of the bridge circuit and via third and fourth amplifier stages 9*c* and 9*d* also to the base of a transistor 11. The construction of the comparator indicator 10 will be described in more detail with reference to FIG. 2**.

The transistor 11 is connected in series with a relay 13 and a light-emitting diode (LED) 12 and is normally conducting. That means that the relay 13 is activated and LED 12 (green) is lit.

A fault which will cause the relay 13 to fall, will automatically switch on a warning indicator 14. When transistor 11 is conducting, a second transistor 16 is in a cut-off state and a second light-emitting diode (LED) 15 is dark.

The warning indicator 14 may for example consist of a flashing light which could be connected in the circuit of the ceiling light 17 in the building, to be sure that it has supply voltage. However, other or additional warning indicators are also conceivable, for instance means which generate acoustic signals.

The other diagonal of the bridge, i.e. the diagonal between the points indicated by 20 and 21, in addition to being connected to the first amplifier stage **9*a* would be connected to a manually operated switch and/or to the contact means 19 of an output relay from any known detector. Said contact means 19** are normally open but close when a button is pressed or a detector is activated.

When the contact means close, a voltage from the secondary output of the transformer or from a DC source is applied to both of the bridge branches comprising the actuator groups A and B, and all the actuators are activated. To protect the input of the first amplifier stage **9*a* the two resistors 18*a* and 18*b*** on the input connections to the first amplifier stage are given a comparatively high value.

The pulse width of the measuring voltage applied on the bridge is kept small, and the repetition rate low to minimize the energy losses in the actuators. It has been noticed that even a small amount of DC current continually applied to an igniter could cause prolonged ignition time or worse, no ignition at all.

FIG. 2 shows an example of how the comparator indicator 10 can be constructed to indicate not only unbalance in the bridge but also the sense of that unbalance. The comparator indicator comprises two operational amplifiers 22, 23 having opposite polarity inputs connected together for receiving negative or positive pulses $U_o$ from the second amplifier stage **9*b*, when there is an unbalance in the bridge circuit. The positive input of the operational amplifier 22 and the negative input of the operational amplifier 23 are connected to reference voltages $U_1$ and $U_2$, respectively. The outputs of the operational amplifiers 22 and 23 are connected to the base of transistors 24 and 25, respectively. Light-emitting diodes (LED:s) 26 and 27 (yellow) are connected in series with the emitters of said transistors. The outputs of the operational amplifiers 22 and 23 are also connected via diodes 28 and 29 to the base of a third transistor 30. The emitter of the third transistor is connected to earth via a further light-emitting diode, LED 31** (green).

The operation of the monitoring circuit will now be further described, it being assumed that initially the bridge is in balance. In this condition the oscillator 8 is continuously feeding the bridge circuit with a pulsed voltage. The differential input of the first amplifier stage **9*a* is zero, and so is also its output. Likewise, the outputs of the second and third amplifier stages 9*b* and 9*c* are zero. The fourth amplifier stage 9*d*, is given a positive threshold level which means that its output is high and transistor 11 is conducting. The relay 13 is activated and green LED 12 is lit. The second transistor 16 is in a nonconducting state and red LED 15** is dark.

The input signal $U_o$ of the comparator (or balance) indicator 10 is zero, but the reference voltage $U_1$ is given a positive and $U_2$ a negative threshold level. The voltage level on the positive input terminal of **9*b* is for instance +0.5 V. Both outputs of the operational amplifiers 22 and 23 are high. The transistors 24 and 25 are in a nonconducting condition and yellow LED:s 26 and 27 are dark. The third transistor 30 is conducting and green LED 31** is lit.

Assume now that the bridge circuit 5 gives an unbalance signal. Depending on an increase or decrease of the resistance value in any of the four branches of the bridge, there will be a positive or negative output signal from the first amplifier stage **9*a***.

The two resistors 6 and 7 in the bridge circuit are choosen to be reliable to temperature and other undesired effects. After the balance of the bridge has been established, the two other branches of the bridge with the actuator groups A and B could be effected by a fault, however, a failing actuator, a short-circuit or anything which gives an unbalance in the bridge. This unbalance is monitored to a front presentation of the system so that it is possible to determine in which branch a failure could be located. The warning indicator 14 is also activated.

Let us first assume that the output signal from the first amplifier stage **9*a* is positive. Then the output signal from the second amplifier stage 9*b* will be negative, the output signal from the third amplifier stage 9*c* goes high and the output from the fourth amplifier stage 9*d*, when the amplitude of the input signal reach the threshold level, will be low and turn off transistor 11. This means that the relay 13 will fall and green LED is put out and remote indicator 14 is activated. The second transistor 16 will receive base current through LED 12 and the relay 13, without influencing on either of their conditions, and turn on. Then red LED 15** is lit.

The negative output signal from the second amplifier stage **9*b*, indicated by $U_o$ in the figures, is applied on the comparator indicator 10. When the output signal $U_o$ turns negative and reaches the threshold level of the amplifier 23, its output turns low. The transistor 25 receives base current from the operational amplifier 23 and becomes conducting. Yellow LED 27 is lit and the circuit point 32 of the comparator indicator will be low and the third transistor 30 will be cut off. Green LED 31** is put out.

Assume now that a negative output signal is provided by the first amplifier stage **9*a*. The output signal from the second amplifier stage 9*b* is then positive, but instead of being amplified in the third amplifier stage 9*c*, the positive signal is shunted from stage 9*b* to the input terminal of the fourth amplifier stage 9*d* via a diode. The following procedure is the same as described above for the positive signal, except from the comparator indicator 10 where now the other channel from the operational amplifier 22 to LED 26** is activated.

The comparator indicator 10 is also utilized for adjusting the balance position of the bridge circuit as it, in contrast to conventional digital or analog indicator methods, rapidly and clearly shows if the bridge circuit is correctly adjusted.

What is claimed is:

1. A fire sprinkler monitoring system comprising at least first and second groups of sprinkler actuators, each group positioned away from the other;

means connecting the first and second groups of actuators as first and second branches of a Wheatstone bridge circuit;

a first resistor connected in the bridge as a third branch;

a second resistor connected in the bridge as a fourth branch and variable for permitting balancing of the bridge;

the first and second group actuators having different effective load resistance in the bridge;

pulsed voltage source means connected as a first diagonal of the bridge for providing low power to the actuators undergoing monitoring;

first amplifying means connected as a second diagonal of the bridge for amplifying the bridge output;

second amplifying means connected at its input to the output of the first amplifying means for amplifying the output therefrom; and comparator means connected to the output of the second amplifying means for indicating an unbalanced condition of the bridge during (a) initial balancing of the bridge and (b) upon occurrence of a fault in one of the actuators.

2. The structure set forth in claim 1 wherein the comparator means comprises:

first and second operational amplifying means having opposite polarity inputs connected together for receiving pulses from the output of the second amplifying means when an unbalanced condition exists in the bridge; and respective electro-optic means connected to the outputs of the operational amplifying means for indicating which branch of the bridge causes an unbalanced condition.

3. The structure set forth in claim 2 together with switching means connected across the second diagonal of the bridge for selectively feeding current to the first and second groups of actuators for the actuation thereof.

4. The structure set forth in claim 1 together with switching means connected across the second diagonal of the bridge for selectively feeding current to the first and second groups of actuators for the actuation thereof.

* * * * *